United States Patent [19]

Klipsch

[11] 4,237,340

[45] Dec. 2, 1980

[54] CROSSOVER NETWORK FOR OPTIMIZING EFFICIENCY AND IMPROVING RESPONSE OF LOUDSPEAKER SYSTEM

[75] Inventor: Paul W. Klipsch, Hope, Ark.

[73] Assignee: Klipsch and Associates, Inc., Hope, Ark.

[21] Appl. No.: 948,976

[22] Filed: Oct. 5, 1978

Related U.S. Application Data

[62] Division of Ser. No. 802,734, Jun. 2, 1977, Pat. No. 4,138,594.

[51] Int. Cl.[2] ..... H04R 3/14; H04R 3/04

[52] U.S. Cl. ..... 179/1 D

[58] Field of Search ..... 179/1 D; 333/28 T, 132, 333/177

[56] References Cited

U.S. PATENT DOCUMENTS

| | | | |
|---|---|---|---|
| 1,711,529 | 5/1929 | Hahnemann | 179/1 D |
| 1,907,723 | 5/1933 | Bostwick | 179/1 D |
| 2,612,558 | 9/1952 | Klipsch | 330/148 |
| 3,657,480 | 4/1972 | Cheng et al. | 179/1 D |
| 3,931,469 | 1/1976 | Elliott et al. | 179/1 D |
| 4,031,321 | 6/1977 | Bakgaard | 179/1 D |

FOREIGN PATENT DOCUMENTS

| | | | |
|---|---|---|---|
| 564460 | 9/1944 | United Kingdom | 179/1 D |

OTHER PUBLICATIONS

H. Tremaine, Audio Cyclopedia; Mar. 1977, Howard W. Sams & Co., Inc., pp. 349, 351–353.

*Primary Examiner*—James W. Moffitt
*Assistant Examiner*—Randall P. Myers
*Attorney, Agent, or Firm*—Wood, Herron & Evans

[57] ABSTRACT

A small dimension low frequency loudspeaker has a folded exponential horn which provides a unitary curved sound path from an electroacoustic transducer at the throat of the horn to a volume into which sound is radiated at the mouth of the horn. The length of the horn is such that, at an exponential rate of expansion between the throat and the mouth, the mouth, when it is bounded by at least one planar surface, such as a floor, a ceiling, and/or walls of a room, has adequate area to enable reproduction of low audible frequencies. An illustrative embodiment of the low frequency loudspeaker has an effective low end cut-off frequency of 55 Hz. A loudspeaker system, including a low frequency loudspeaker as well as midrange and high frequency loudspeakers and an LC crossover network, is also disclosed. The LC crossover network includes an autotransformer which not only serves as a component to determine a crossover frequency but which also boosts the electrical signal that is input to the electroacoustic transducer of a less efficient loudspeaker. The autotransformer increases the output of the less efficient loudspeaker and accommodates its use with more efficient loudspeakers so that the overall loudspeaker system operates at optimum efficiency. An illustrative embodiment of the loudspeaker system affords 108 dB SPL output at one meter with one watt input which corresponds to about 20% overall efficiency. The smoothness of amplitude response over the range of audible frequencies that is necessary for high fidelity sound reproduction is improved by inclusion of peaking circuits in the LC crossover network of the loudspeaker system to enhance amplitude response in the regions of crossover frequencies. Side wings are additionally provided to eliminate cavities at the sides of the loudspeaker system which would otherwise cause deterioration of smoothness of amplitude response.

5 Claims, 6 Drawing Figures

CROSSOVER NETWORK FOR OPTIMIZING EFFICIENCY AND IMPROVING RESPONSE OF LOUDSPEAKER SYSTEM

This is a division of application Ser. No. 802,734, filed June 2, 1977 now U.S. Pat. No. 4,138,594.

BACKGROUND OF THE INVENTION

This invention relates to an electroacoustical device and, more particularly, to a loudspeaker for reproduction of low audible frequencies. Specifically, this invention relates to a small dimension low frequency folded exponential horn loudspeaker which has a unitary sound path for direction of acoustical waves from an electroacoustic transducer to a volume into which the acoustical waves are radiated. Moreover, this invention relates to a loudspeaker system, including a low frequency loudspeaker and midrange and high frequency loudspeakers and an LC crossover network, which operates at optimum efficiency and which has a smooth amplitude response over the range of audible frequencies that is necessary for high fidelity sound reproduction.

High fidelity sound reproduction requires reproduction of low audible frequencies. W. B. Snow, "Audible Frequency Ranges of Music, Speech, and Noise", Jour. Acous. Soc. Am., Vol. 3, July, 1931, p. 155, for example, indicates that high fidelity sound reproduction of orchestral music requires that the frequency band should extend to as low as 40 Hz.

It is well established that loudspeakers, in order to reproduce a given frequency range, must have dimensions based on the wavelength which corresponds to the lowest frequency in the range. In the case of one type of loudspeaker, the exponential horn loudspeaker, for example, the area of the exponential horn mouth is determined on the basis of the wavelength of the lowest frequency to be reproduced.

At an early date, to obtain high fidelity sound reproduction with exponential horn loudspeakers, and, in particular, the inclusion of low audible frequencies, large exponential horn loudspeakers were constructed. For example, theater loudspeakers as large or larger than eight feet in length and four feet by four feet in transverse dimensions were built in order to obtain reproduction of low audible frequencies. Later, the outside dimensions of the exponential horns were reduced by folding, but even then the dimensions of the mouths were large for reproduction of low audible frequencies. More recently, folded exponential horn loudspeakers with reduced mouth dimensions have been used in proximity to boundary surfaces, such as a floor, a ceiling, and/or walls of a room, to increase the effective mouth area so that low audible frequencies are reproduced while at the same time the dimensions of the low frequency loudspeakers are minimized. See, for example, Sandeman, U.S. Pat. No. 1,984,550, Klipsch, U.S. Pat. Nos. 2,310,243 and 2,373,692, and Klipsch, "La Scala", Audio Engineering Society Preprint No. 372, April, 1965.

Prior art low frequency folded exponential horn loudspeakers, such as those which are disclosed in the above-cited references, have small dimensions and, when their mouths are located proximate planar surfaces, enable reproduction of low audible frequencies. However, each of these prior art low frequency folded exponential horn loudspeakers is structurally complex due to the structure of the folded exponential horn which defines the sound path from the electroacoustic transducer to the volume into which sound is radiated. Perhaps the simplest construction appears in the above-cited Audio Engineering Society publication. In that construction, the folded exponential horn is bifurcated to define a double sound path.

Due to the complex structure, the production of high fidelity, small dimension, low frequency folded exponential horn loudspeakers has required considerable craftsmanship. High quality control in manufacture has been necessary to assure that the construction meets specifications. Consequently, the cost of low frequency folded exponential horn loudspeakers has been high. Furthermore, the amount of material which has been used in some structurally complex prior art low frequency folded exponential horn loudspeakers has meant that these loudspeakers do not have the high degree of portability which is required by traveling musicians.

One objective of this invention is to provide a low frequency loudspeaker of the folded exponential horn type which cooperates with boundary surfaces so that reproduction of low audible frequencies is obtained with a loudspeaker that has small dimensions in relation to the wavelength of the lowest audible frequency to be reproduced.

Another objective of this invention is to provide a low frequency folded exponential horn loudspeaker with a simplified structure without sacrificing high fidelity sound reproduction or small dimensions.

Another objective of this invention is to provide a comparatively low cost folded exponential horn loudspeaker.

Another objective of this invention is to provide a low frequency loudspeaker for the traveling musician who needs highly portable sound reinforcement over the low vocal range and the bass range of some musical instruments.

A further objective of this invention is to provide a loudspeaker system, including a low frequency folded exponential horn loudspeaker and midrange and high frequency loudspeakers and an LC crossover network, for reproduction of audible frequencies of the acoustical spectrum without harmonic distortion.

Another objective of this invention is to provide a loudspeaker system which operates at optimum efficiency.

Another objective of this invention is to provide a loudspeaker system which has a smooth amplitude response over the range of audible frequencies that is necessary for high fidelity sound reproduction.

A further objective of this invention is to enhance the overall smoothness of the amplitude response of a loudspeaker system over a range of audible frequencies.

An additional objective of the present invention is to provide a loudspeaker system which can be used for radiation of sound into either a $\pi$ solid angle or a $\pi/2$ solid angle without deterioration of smoothness of amplitude response.

SUMMARY OF THE INVENTION

The present invention provides a simplified structure for a high fidelity, small dimension, low frequency folded exponential horn loudspeaker. The low frequency loudspeaker has a folded exponential horn which provides a unitary curved sound path from an electroacoustic transducer at the throat of the horn to a volume into which sound is radiated at the mouth of the horn. The length of the horn is such that, at an exponential rate of expansion between the throat and the mouth, the mouth, when it is bounded by at least one planar surface, such as a floor, a ceiling, and/or walls of a room, has adequate area to enable reproduction of low audible frequencies. An illustrative embodiment of the low frequency loudspeaker of the present invention has a low end cut-off frequency below 70 Hz. Advantageously, the low frequency loudspeaker of the present invention has high output capacity and efficiency. The simplified structure of the folded exponential horn facilitates construction and reduces the weight as well as lowers the cost of production.

The folded exponential horn of the low frequency loudspeaker of the present invention includes a panel with an aperture proximate the diaphragm of a low frequency electroacoustic transducer. The panel is connected to a vertical back wall by an upper support baffle, such that the panel is spaced apart from and acutely angled with respect to the vertical back wall. The diaphragm of the low frequency transducer is acoustically coupled to the space between the panel and the back wall by the aperture.

A horizontal lower wall is connected by a lower support baffle to the back wall and extends to the plane of a vertical opening. A front support baffle, which is spaced above the lower wall and acutely angled upwardly, is connected to the panel and extends to the plane of the opening.

Two vertical side walls are oppositely disposed in spaced planes which are perpendicular to the line which is formed by the intersection of the planes of the back and lower walls. The two side walls abut opposite edges of the panel, the upper, lower, and front support baffles, and the back and lower walls.

The panel, baffles, and walls define a unitary curved sound path from the aperture, or throat, to the opening, or mouth. These members may have exponentially curved surfaces but preferably are flat surface approximations to exponentially curved surfaces to facilitate construction.

The present invention also provides a loudspeaker system which includes a low frequency folded exponential horn loudspeaker and additionally includes midrange and high frequency straight exponential horn loudspeakers and an LC crossover network. An autotransformer in the LC crossover network boosts the electrical signal that is input to the electroacoustic transducer of a less efficient loudspeaker. In an illustrative embodiment of the loudspeaker system of the present invention, for example, the high frequency loudspeaker is less efficient than the low frequency and midrange frequency loudspeakers, which operate with comparable efficiency. Since the electrical signal to the electroacoustic transducer of the less efficient loudspeaker is boosted, the output of the less efficient loudspeaker is increased. This accommodates use of the less efficient loudspeaker with the more efficient loudspeakers and enables the overall loudspeaker system to operate with optimum efficiency.

The loudspeaker system of the present invention has a smooth frequency response characteristic over the range of audible frequencies that is necessary for high fidelity sound reproduction. The smoothness of frequency response is enhanced by inclusion in the LC crossover network of "peaking" circuits which are effective to increase the amplitude of the response at frequencies near lower and upper crossover frequencies. Side wings are preferably included to eliminate cavities at the sides of the loudspeaker system of the present invention to prevent deterioration of smoothness of amplitude response.

The objectives of the present invention will become better understood and the advantages of the present invention will become clear to those of skill in the art by a consideration of the detailed description of a low frequency loudspeaker and a loudspeaker system in accordance with illustrative embodiments of the present invention in connection with the drawing in which.

Figure 2:
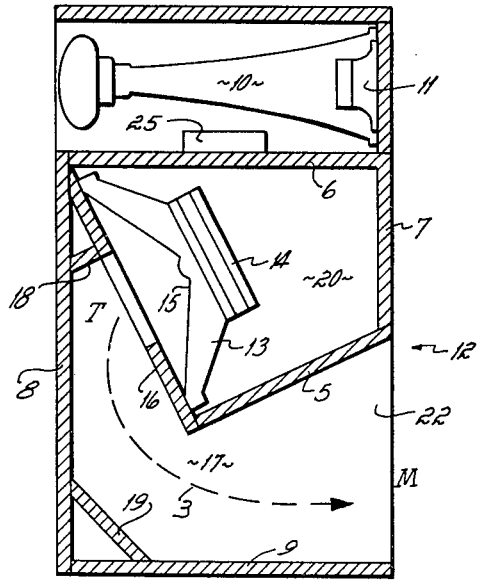
FIG. 2 is a sectional view along line 2—2 of FIG. 1.

With reference to FIG. 2, a low frequency loudspeaker, which is designated generally by the numeral 12, includes a low frequency electroacoustic transducer 13 which has an electromagnet 14 that is responsive to an electrical signal to vibrate a diaphragm 15. The electroacoustic transducer 13 vibrates air such that the electrical signal is converted to acoustical, or sound, waves. The magnitude of vibration of the diaphragm 15 by the electromagnet 14 at a particular frequency is proportional to the amplitude of the component at that frequency in the electrical signal. The electroacoustic transducer 13 is conventional in design and may be, for example, a 15-inch cone-type diaphragm electroacoustic transducer.

The electroacoustic transducer 13 is secured, for example, by means of screws (not shown) to a panel 16 which has an aperture that forms the throat T of a folded exponential horn 17. In accordance with the present invention, the folded exponential horn 17 defines a unitary curved sound path, which is indicated by the dashed line 3, to interconnect the throat T of the exponential horn 17 to the mouth M of the exponential horn 17. The mouth M provides an opening into a volume of air such as a room, auditorium, theater, etc.

When an electrical signal is input to electromagnet 14, therefore, diaphragm 15 vibrates, and acoustical, or sound, waves propagate through the throat T, along the unitary sound path 3, and through the mouth M into the volume of air. Hence, a listener who is positioned within the volume of air hears the sound.

Figure 3:
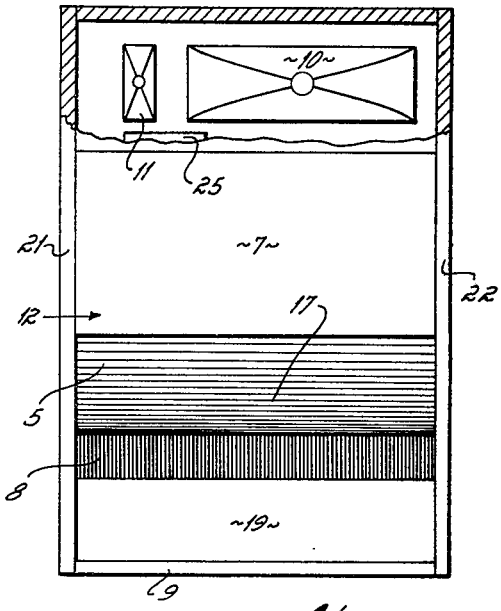
FIG. 3 is a front view of the loudspeaker system of FIG. 1.

With reference to FIGS. 2 and 3, the structure of the exponential horn 17 will now be described. As best shown in FIG. 2, the exponential horn 17 of the low frequency loudspeaker of the present invention includes a panel 16 with an aperture T, which comprises the throat of the exponential horn 17 and which is proximate the diaphragm 15 of the electroacoustic transducer 13. The panel 16 is connected to a vertical back wall 8 by an upper support baffle 18, such that the panel 16 is spaced apart from and acutely angled with respect to the vertical back wall 8. The diaphragm 15 of the electroacoustic transducer 13 is acoustically coupled to the space between the panel 16 and the back wall 8 by the throat T.

A horizontal lower wall 9 is connected by a lower support baffle 19 to the back wall 8 and extends to the plane of a vertical opening M which comprises the mouth of the exponential horn 17. A front support baffle 5, which is spaced above the lower wall 9 and acutely angled upwardly, is connected to the panel 16 and extends to the plane of the mouth M.

As best shown in FIG. 3, two vertical side walls 21 and 22 are oppositely disposed in spaced planes which are perpendicular to the line formed by the intersection of the planes of the back wall 8 and the lower wall 9. The two side walls 21 and 22 abut opposite edges of the panel 16, the upper, lower, and front support baffles 18, 19, 5, and the back and lower walls 8, 9.

Where the low frequency loudspeaker 12 is intended to be portable, the lower wall 9 not only serves as a sound baffle but also adds strength to the overall structure. However, if the low frequency loudspeaker 12 is to sit on a smooth floor or to be mounted to a smooth ceiling of sound reflective material, the floor or ceiling may constitute the lower wall 9.

Figure 6:
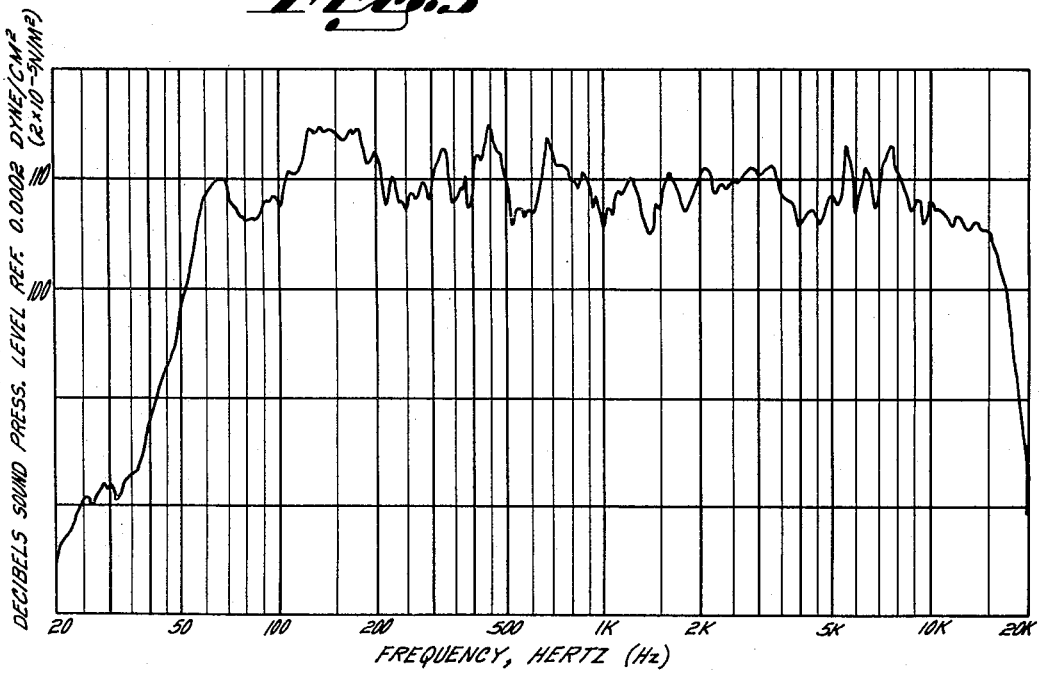
FIG. 6 is a performance curve, which shows the amplitude response at various frequencies, for an illustrative embodiment of a loudspeaker system in accordance with the present invention.

The structure of the exponential horn 17 preferably has elements which have flat surfaces that approximate exponentially curved surfaces rather than surfaces which are curved in accordance with the exponential function. It has been found that the use of flat elements in a low frequency loudspeaker of the exponential horn type does not greatly detract from high fidelity reproduction of low audible frequencies. The use of flat elements, rather than exponentially curved elements, is demonstrated by Olson and Massa, "A Compound Horn Loudspeaker", Jour. Acous. Soc. Am., July, 1936, pp. 48–52, wherein FIG. 6 shows horns with true exponentially curved surfaces and horns with flat surfaces that approximate exponentially curved surfaces. These authors state that comparison demonstrates very little difference for operation at frequencies below 300 Hz. The use of flat surfaces instead of exponentially curved surfaces in the illustrative embodiment of the present invention facilitates construction of the exponential horn 17. The present invention, however, contemplates the use of elements with exponentially curved surfaces as well as flat surfaces.

With reference to FIGS. 2 and 3, panel 16, top wall 6, front wall 7, front support baffle 5, side wall 21, and, finally, side wall 22 form a back air chamber 20 for the electroacoustic transducer 13. The back air chamber 20 has two purposes: (1) to neutralize the inductive reactance of the throat impedance of the exponential horn 17 in the low frequency pass band and (2) to act as an element of a high pass filter which is effective in the lower cut-off region to increase the reactive load on the diaphragm 15 to limit unwanted vibration which would otherwise cause modulation distortion. The back air chamber 20 must be substantially airtight. Otherwise, the back air chamber 20 will appear as a combination of acoustic resistance and inductive reactance instead of pure acoustic capacitive reactance as desired when the electroacoustic transducer 13 is operative in the low frequency pass band.

In summary, the low frequency loudspeaker 12 of the present invention includes an electroacoustic transducer 13 with a substantially airtight back air chamber 20. The low frequency loudspeaker 12 further includes an exponential horn 17 which is preferably constructed with flat elements that approximate exponentially curved surfaces to facilitate construction. The low frequency loudspeaker 12 has relatively small dimensions since the exponential horn 17 is folded as shown by the curved sound path 3 which extends from the electroacoustic transducer 13 at the throat T to the volume into which sound is radiated at the mouth M. The low frequency loudspeaker 12 has a simplified structure since the folded exponential horn defines a unitary curved sound path 3.

As an example of a low frequency loudspeaker in accordance with the present invention, a specific construction will now be described for radiation of sound into a $\pi/2$ solid angle. The specific construction relates a low frequency loudspeaker of the type which has been described above that is intended for the traveling musician who needs portable sound reinforcement for the low vocal range and the upper bass range of some musical instruments. The lowest significant fundamental of the male voice, for example, is about 100 Hz., and typical accompanying instruments generally have significant output down to about 70 Hz. Accordingly, a specific construction will be given for a low frequency loudspeaker which has a low end cut-off frequency below 70 Hz.

Selection of the electroacoustic transducer 13 is based primarily upon power requirements and frequency response in the desired frequency range of from below 70 Hz. to at least 400 Hz. The low end of the frequency range derives from the fact that typical accompanying instruments for traveling musicians have significant output down to about 70 Hz. The high end of the frequency range derives from the use in the illustrative embodiment of flat surface approximations to exponentially curved surfaces to facilitate horn construction as indicated previously. Accordingly, a KLIPSCH K33E 15-inch cone-type diaphragm electroacoustic transducer may be used for the electroacoustic transducer 13.

Once the electroacoustic transducer 13 has been selected, the characteristics of the selected electroacoustic transducer which are published by the manufacturer can be used to determine the area for the throat T of the exponential horn 17 in accordance with the article by Wente and Thuras, "Auditory Perspective-Loud Speakers and Microphones", Trans. A.I.E.E., January, 1934, pp. 19–20. The throat area thus determined provides maximum power transfer, or efficiency, for the selected electroacoustic transducer. For the KLIPSCH K33E, the throat area must be approximately 78 square inches, or 503 square centimeters.

Since a response below 70 Hz. is desired, a low end cut-off frequency of 63.4 Hz. may be selected. With 63.4 Hz. as the selected low end cut-off frequency, the wavelength which corresponds to this frequency can be determined, since the wavelength is equal to the velocity of sound divided by the frequency. Since the velocity of sound in air is approximately 13,550 inches a second, the wavelength which corresponds to the selected low end cut-off frequency of 63.4 Hz. is approximately 213 inches, or 543 centimeters.

The diameter (equivalent circle) of the mouth of a horn must be a substantial fraction of a wavelength if the impedance at the throat of the horn is not to vary appreciably with frequency. Kellogg, "Means for Radiating Large Amounts of Low Frequency Sound", Jour. Acous. Soc. Am., July, 1931, p. 105, indicates that the mouth diameter (equivalent circle) of an exponential horn should at least be a half wavelength (and preferably more) at the lowest frequency to be reproduced but may be safely reduced to a third wavelength if the mouth is surrounded by a plane baffle of infinite extent as in the case where the exponential horn ends in a hole in a large baffle or wall for a loudspeaker to radiate sound into a $2\pi$ solid angle, or hemisphere.

Although Kellogg expounds the general rule, Wente and Thuras in their above-cited article indicate that the effect of variations in impedance on the sound output which results from the use of a horn with a mouth diameter (equivalent circle) less than one-half wavelength can be kept down to a relatively small value if the electroacoustic transducer is properly selected. Consequently, Wente and Thuras have used a mouth diameter (equivalent circle) of approximately one-sixth wavelength of the low end cut-off frequency for a loudspeaker to radiate sound into a $2\pi$ solid angle.

The mouth diameter (equivalent circle) may be one-half as great for a low frequency loudspeaker that is constructed preferably for radiation into a $\pi/2$ solid angle, that is, for a low frequency loudspeaker which is placed, for example, in the corner of a room. Consequently, the diameter of the mouth M (equivalent circle) may be one-twelfth wavelength of the selected low end cut-off frequency of 63.4 Hz. This translates to a mouth diameter (equivalent circle) of approximately 17.8 inches, or 45 centimeters, and a mouth area of approximately 249 square inches, or 1,607 square centimeters.

As shown in FIG. 3, the mouth of the illustrative embodiment of the low frequency loudspeaker in accordance with the present invention is rectangular. An 18 inch by 14 inch rectangular mouth results in a 252 square inch, or 1,626 square centimeter, mouth area and exceeds the 249 square inch, or 1,607 square centimeter, minimum value established by the criterion of Wente and Thuras.

The rate of expansion of an exponential horn must not exceed that in which the cross section of the exponential horn increases in the ratio $\epsilon$ or approximately 2.7183 in an axial length of $\frac{1}{4}\pi$ times the wavelength of the lowest frequency to be reproduced. Stated differently, the cross-sectional area of an exponential horn may no more than double in approximately 1/18.1 times the wavelength of the lowest frequency to be reproduced as indicated by Kellogg in his above-cited article. Consequently, because the wavelength at 63.4 Hz. is approximately 213 inches, the cross-sectional area of the exponential horn of the illustrative embodiment of the low frequency loudspeaker of the present invention may no more than double approximately every 11.8 inches, or 30 centimeters. Since the exponential horn 17 must expand from 78 square inches at the throat to 252 square inches at the mouth, the mean length of the sound path 3 in FIG. 2 is established at approximately 20 inches, or 50.8 centimeters.

Kellogg is his above-cited article indicates that folds may be made in an exponential horn, that is, the exponential horn may be bent without seriously altering the operation of the exponential horn, provided that the difference between the shortest and longest sound path is less than a half wavelength. Given this criterion and the throat area, mean sound path length, and mouth area, the exponential horn 17 of the illustrative embodiment of the present invention which appears in FIGS. 2 and 3 can be constructed. As pointed out above, to facilitate construction, elements with flat surfaces which approximate exponentially curved surfaces are used. However, exponentially curved surfaces may be used and would preferably be used in a low frequency loudspeaker which operates in a range that extends significantly above 300 Hz.

Klipsch, "A Low Frequency Horn of Small Dimensions", Jour. Acous. Soc. Am., Vol. 13, No. 2, 1941, pp. 137–144, derives the analytical expression for the volume of a back air chamber. Theoretically, the back air chamber 20 should be about 10–20% larger to compensate for the flexure of the suspended diaphragm 15 and for the immersed volume of the electromagnet 14 of the electroacoustic transducer 13 in FIG. 2. Since a 20% change in the volume of a back air chamber has been found to produce less than approximately one decibel of response error and since error toward a smaller back air chamber results in less modulation distortion due to subsonic inputs, the back air chamber 20 preferably has a volume of 2,730 cubic inches, or 44.74 liters, so that the volume is only 2%, rather than 10–20%, larger than the analytical value.

Mathematically, the use of the back air chamber 20 with a volume of 2% larger than the analytical value raises the effective low end cut-off frequency between 5 and 10%, from 63.4 Hz. to between 66 and 70 Hz. Since in the illustrative embodiment of the low frequency loudspeaker of the present invention a target low end cut-off frequency of approximately 70 Hz. has been selected, the increase in the low end cut-off frequency, due to the use of the back air chamber 20 with a volume only 2% larger than the analytical value, is acceptable.

The values for the various parameters for a specific construction of a low frequency loudspeaker in accordance with the illustrative embodiment of the present invention in FIGS. 2 and 3 are summarized in Table I.

TABLE I

| LOW FREQUENCY LOUDSPEAKER | | |
|---|---|---|
| Electroacoustic Transducer | = | KLIPSCH K33E |
| Analytical Low End Cut-off Frequency | = | 66–70 Hz. |
| Throat Area | = | 78 Square Inches |
| Mouth Area | = | 252 Square Inches |
| Rate of Expansion of Horn | = | Cross-Sectional Area Doubles Every 11.8 Inches |
| Mean Sound Path Length | = | 20 Inches |
| Volume of Back Air Chamber | = | 2,730 Cubic Inches |

The low frequency loudspeaker of the present invention may be incorporated into a loudspeaker system which further includes a midrange frequency loudspeaker and a high frequency loudspeaker together with an LC crossover network which establishes the frequency ranges for the various loudspeakers.

A straight axis exponential horn may be used in connection with an appropriate electroacoustic transducer to form the midrange frequency loudspeaker 10 as shown in FIGS. 1–4. A midrange frequency loudspeaker similar to the one which is described in Klipsch, "A New High Frequency Horn", I.R.E. Trans. on Audio, Vol. AU-11, No. 6, November-December, 1963, pp. 202–206, with a low end cut-off frequency of 375 Hz., for example, may be used.

An illustrative embodiment for the midrange frequency loudspeaker 10 includes a KLIPSCH K55V electroacoustic transducer. For maximum power transfer, or efficiency, with the KLIPSCH K55V electroacoustic transducer, the throat area of the midrange frequency loudspeaker exponential horn must be approximately 0.4 square inch, or 2.6 square centimeters. Since the midrange frequency loudspeaker 10 due to its position in the loudspeaker system of the present invention effectively radiates sound into a $2\pi$ solid angle, the diameter (equivalent circle) of the mouth must be at least one-sixth wavelength of the 375 Hz. low end cut-off frequency in accordance with the criterion of Wente and Thuras in their above-cited article. Based on the dimensions of the specific construction for the low frequency loudspeaker in accordance with an illustrative embodiment of the present invention, an exponential horn for the midrange frequency loudspeaker 10 with a mouth area of 46 square inches, or 297 square centimeters, may be conveniently used. This translates to a mouth which has a diameter (equivalent circle) of 1/4.7 wavelength of the low end cut-off frequency of 375 Hz. which exceeds the minimum value established by the criterion of Wente and Thuras. In accordance with the above-cited Kellogg article, the cross-sectional area of the exponential horn for the midrange frequency loudspeaker 10 must not double in less than 2 inches. Given the throat area, mouth area, and rate of expansion for the midrange frequency loudspeaker straight exponential horn, a mean sound path length of approximately 15 inches, or 97 centimeters, is established. The back air chamber for the midrange frequency loudspeaker 10 requires a volume of 2.55 cubic inches, or 41.8 cubic centimeters, or equivalent combined air chamber and diaphragm suspension compliance. The data for the midrange frequency loudspeaker 10 for the illustrative embodiment of a loudspeaker system in accordance with the present invention are tabulated in Table II.

TABLE II

| MIDRANGE FREQUENCY LOUDSPEAKER | | |
|---|---|---|
| Electroacoustic Transducer | = | KLIPSCH K55V |
| Analytical Low End Cut-off Frequency | = | 375 Hz. |
| Throat Area | = | 0.4 Square Inch |
| Mouth Area | = | 46 Square Inches |
| Rate of Expansion of Horn | = | Cross-Sectional Area Doubles Every 2 Inches |
| Mean Sound Path Length | = | 15 Inches |
| Volume of Back Air Chamber | = | 2.55 Cubic Inches or equivalent combined air chamber and diaphragm suspension compliance |

A KLIPSCH K-77 may be used for the high frequency loudspeaker 11 of the illustrative embodiment of the loudspeaker system of the present invention. Although the efficiency of this high frequency loudspeaker is lower than either the low or midrange frequency loudspeakers, the power demand in the high audible frequency range, that is, in the range of 6,000–15,000 Hz., is small. Consequently, an autotransformer may be incorporated into an LC crossover network as described below so as to permit use of the KLIPSCH K-77.

The figures indicate that the midrange frequency loudspeaker 10 and the high frequency loudspeaker 11 are mounted in close proximity to the low frequency loudspeaker 12 to minimize the size of the loudspeaker system of the present invention. An LC crossover network 25 interconnects the three loudspeaker sections to an amplifier (not shown) which drives the electroacoustic transducers that are associated with the loudspeaker system.

Certain principles must be observed if good overall sound quality is to be obtained: (1) the exponential horns of the midrange and high frequency loudspeakers must have straight, that is, not folded or reflexed, axes since folding would result in severe variations in amplitude response; (2) sound localization must be considered in connection with the midrange and high frequency loudspeakers; (3) the outputs of the loudspeakers must be balanced; and (4) the human ear is most sensitive to audible frequencies in the range of 300–6,000 Hz., and, consequently, the overall loudspeaker system must operate with high fidelity in this range. The configuration of the loudspeakers shown in FIGS. 1–4 indicates application of the first two principles since the midrange and high frequency loudspeakers have straight exponential horns and are located above the low frequency loudspeaker so as to be positioned above the floor, for example, to reduce reflection and provide a better localization effect for the listener. The second two principles will now be discussed in conjunction with an LC crossover network in accordance with the present invention.

Figure 5:
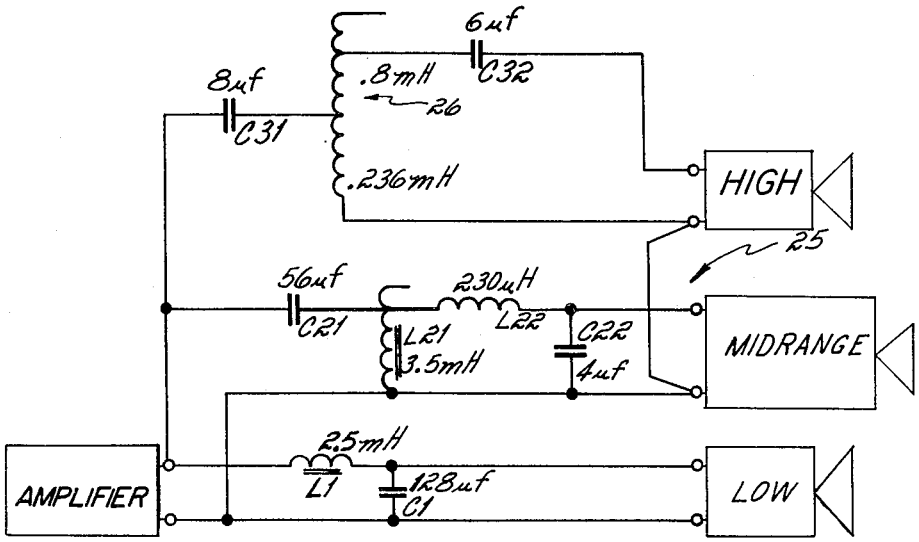
FIG. 5 is a schematic diagram of an LC crossover network with values shown for implementation of an illustrative embodiment of a loudspeaker system in accordance with the present invention.

As shown in FIG. 5, the LC crossover network 25 for the loudspeaker system of the present invention comprises two-pole passive networks for each of the low and midrange frequency loudspeakers and a three-pole passive network for the high frequency loudspeaker. An autotransformer 26 is incorporated into the LC crossover network 25 of the present invention to accommodate the use of a high frequency loudspeaker which is less efficient than the low and midrange frequency loudspeakers. In contradistinction to known prior art techniques, the electrical signals that are input to the more efficient loudspeakers are not reduced so as to accommodate use of a less efficient loudspeaker. Instead, the electrical signal to the less efficient loudspeaker is boosted so that the output of the less efficient loudspeaker is in balance with the outputs of the more efficient loudspeakers. This accommodates use of the less efficient loudspeaker with the more efficient loudspeakers and enables the loudspeaker system of the present invention to operate at optimum efficiency.

The LC crossover network 25 of the present invention is a selective network to divide the audio frequency output of an amplifier, which drives the electroacoustic transducers, into three bands of frequencies. The frequency separation is employed to feed the three electroacoustic transducers so that each operates in a restricted frequency band and thereby operates more efficiently and with less distortion. In the loudspeaker system of the present invention, the LC crossover network 25 has been selected for crossover between the low and midrange frequency loudspeakers at a frequency of approximately 400 Hz. and between the midrange and high frequency loudspeakers at a frequency of approximately 6,000 Hz.

With reference to FIG. 5, the LC crossover network 25 incorporates inductors and capacitors connected to provide a low pass filter for feeding the low frequency electroacoustic transducer that is connected across the LOW terminals; a band pass filter for feeding the midrange frequency electroacoustic transducer that is connected across the MIDRANGE terminals; and a high pass filter for feeding the high frequency electroacoustic transducer that is connected across the HIGH terminals. At the 400 Hz. crossover frequency, the power output of the low pass filter for the low frequency loudspeaker and the power output of the band pass filter for the midrange frequency loudspeaker are approximately equal. At 6,000 Hz., the power output of the band pass filter for the midrange frequency loudspeaker and the power output of the high pass filter for the high frequency loudspeaker are approximately equal. At these frequencies, the outputs of the various filters are approximately 3 decibels (dB) below peak amplitude response level.

The LC crossover network 25 of the present invention includes "peaking" circuits to achieve slight improvements in smoothness of amplitude response near the selected crossover, or transitional, frequencies. Accordingly, with reference to FIG. 5, $L_1$, $C_1$ produce a three dB rise at approximately 350 Hz. $L_{21}$, $C_{21}$ produce a similar rise at approximately 450 Hz. $L_{22}$, $C_{22}$ produce a rise at approximately 5,500 Hz. Similarly, autotransformer 26 and capacitors $C_{31}$, $C_{32}$ produce a rise at approximately 6,500 Hz.

The values for the various components in one implementation of the LC crossover network 25 of the present invention are indicated in FIG. 5. The autotransformer 26 may be a KLIPSCH T-2-A autotransformer with iron removed. $L_{21}$ may be a KLIPSCH T-2-A autotransformer with "E" iron only, the "I" iron having been removed. $L_1$ and $L_{22}$ may have iron, as shown in the case of $L_1$, or air core, as shown in the case of $L_{22}$. When iron is present in any of the inductive components, however, an air gap is preferably provided so that saturation does not occur during operaton. Consequently, the inductive reactance of these inductive components remains constant. This in turn means that the frequency separation which is provided by the LC crossover network 25 remains fixed and that each electroacoustic transducer is driven in a restricted frequency band where each electroacoustic transducer operates more efficiently and with less distortion.

The peaking circuits are resonant near the indicated frequencies so as to increase the amplitude of the response of the various filters near these frequencies. Consequently, the amplitude response of the loudspeaker system of the present invention, which is shown in FIG. 6, is more smooth in the area of the 400 Hz. and 6,000 Hz. crossover frequencies.

The peaking effect derives from the fact that the LC crossover network has lower input, or driving point, impedance near the resonant frequencies of the various peaking circuits. At these frequencies, the input impedance drops from 8 or 16 ohms to as low as 4 ohms. Consequently, conventional solid state amplifiers, which are characteristically designed to deliver their maximum output into a 4 ohm load, produce a high output near the crossover frequencies of 400 and 6,000 Hz. where the outputs of the loudspeakers are drooping.

In the practice of the present invention, the value of the inductors and capacitors which are used in the peaking circuits can be derived analytically based on the selected crossover frequencies. Slight adjustments by means of a variable inductor and/or capacitor then produce the lowest peak-trough ratio so that a smooth amplitude response curve results. Values may be "tailored" to modify response.

The presence of cavities at the sides of a loudspeaker system causes deterioration in the smoothness of amplitude response. It is desirable, therefore, that the mouths of the loudspeakers are bounded by a large baffle to avoid cavities at the sides of the loudspeaker system. See, Klipsch, "Eight Cardinal Points in Loudspeakers for Sound Reproduction", I.R.E. Trans. on Audio. Vol. AU-9, No. 6, November-December, 1961, pp. 204–209.

In practical use, the loudspeaker system of the present invention will be positioned, for example, against the floor or ceiling of a room or auditorium or on the platform of a stage for radiation of sound into a $\pi$ solid angle or in a corner bounded by a floor or ceiling and two intersecting walls for radiation of sound into a $\pi/2$ solid angle. If the loudspeaker system of the present invention, which in general shape is a rectangular structure, is placed in a corner, for example, cavities at the sides would cause deterioration of smoothness of amplitude response.

Figure 1:
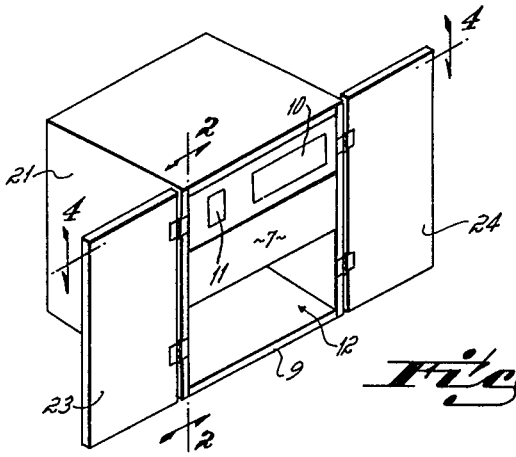
FIG. 1 is a perspective view of a loudspeaker system in accordance with the present invention.
Figure 4:
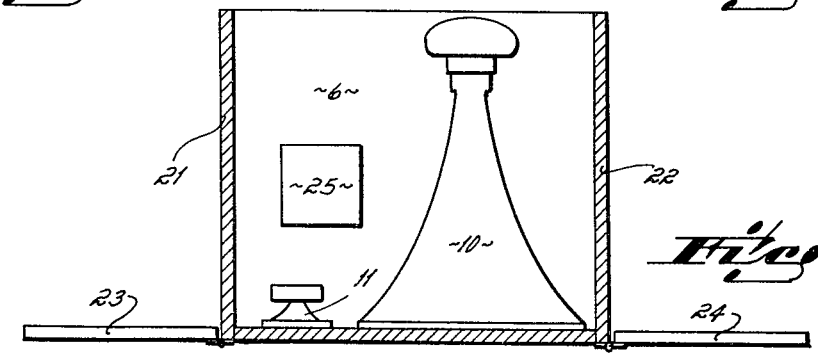
FIG. 4 is a sectional view along line 4—4 of FIG. 1.

In the illustrative embodiment of the loudspeaker system of the present invention, therefore, side wings 23 and 24 are used to eliminate cavities at the sides of the loudspeaker system as shown in FIGS. 1 and 4. Side wings 23 and 24 may be attached by means of hinges to side walls 21 and 22, respectively, if desired, as shown in FIGS. 1 and 4.

FIG. 6 shows the amplitude response characteristic of a specific construction for the loudspeaker system in accordance with the illustrative embodiment of the present invention. The amplitude response characteristic in FIG. 6 was obtained by means of three microphones in a typical listening room as described by W. B. Snow, "Loudspeaker Testing in Rooms", Jour. Audio Eng. Soc., Vol. 9, No. 1, January, 1961, pp. 54–60.

As described above, the analytical value of the low end cut-off frequency was selected to be below 70 Hz. FIG. 6 indicates that the effective low end cut-off frequency is approximately 55 Hz., which is the point where the amplitude response is 10 dB below peak amplitude response. This is in accordance with Klipsch, "A Note on Acoustic Horns", Proc. I.R.E., Vol. 33, No. 7, July, 1945, pp. 447–449, wherein the author indicates that there is not a sharp cut-off at the analytical cut-off frequency.

As shown in FIG. 6, the amplitude response is relatively smooth over the operating range from approximately 55 Hz. to 15,000 Hz. The amplitude response curve in FIG. 6 shows a peak-trough ratio of less than 10 dB over the most significant part of this operating range.

The loudspeaker system affords approximately 108 dB SPL output at one meter with an input of one watt of power, which corresponds to an efficiency of approximately 20%. At an input capacity of 200 peak watts (100 watts amplifier rating) the loudspeaker system also affords over 80 dB SPL at 30 meters (100 feet) ourdoors.

Having described my invention, I claim:

1. In a loudspeaker system having low, midrange, and high frequency loudspeakers and an LC crossover network, wherein at least one of said loudspeakers is less efficient than other of said loudspeakers, the improvement in said LC crossover network, comprising:

an autotransformer included in said LC crossover network and connected between an amplifier and said at least one less efficient loudspeaker for boosting the audio frequency input to said at least one less efficient loudspeaker, whereby the output of said at least one less efficient loudspeaker is increased to enable use of said at least one less efficient loudspeaker with said other loudspeakers and whereby the overall loudspeaker system operates at optimum efficiency.

2. In a loudspeaker system having at least n loudspeakers, wherein n is greater than one, and an LC crossover network dividing the audio frequency output of an amplifier into n frequency bands, each said frequency band driving a separate one of said loudspeakers, there being n−1 crossover frequencies, the improvement in said LC crossover network, comprising:

at least one peaking circuit means included in said LC crossover network and resonant near at least one crossover frequency for enhancing the amplitude response of said loudspeaker system, whereby said loudspeaker system has a smooth amplitude response characteristic in the region of said at least one crossover frequency.

3. The loudspeaker system of claim 2 wherein there are three loudspeakers, including low, midrange, and high frequency loudspeakers, and two crossover frequencies, and said LC crossover network has peaking circuit means resonant near each said crossover frequency to enhance the amplitude response of said loudspeaker system in the region of each said crossover frequency.

4. The loudspeaker system of claim 3 wherein said crossover frequencies are approximately 400 and 6,000 Hz. and said peaking circuit means are resonant at approximately 350, 450, 5,500, and 6,500 Hz.

5. The loudspeaker system of claim 2 wherein said at least one peaking circuit means includes an adjustable impedance, whereby said at least one peaking circuit means is adjustable for obtaining the lowest peak-trough ratio for said amplitude response characteristic of said loudspeaker system.

* * * * *